US005472459A

United States Patent [19]

Aktinson

[11] Patent Number: 5,472,459

[45] Date of Patent: Dec. 5, 1995

[54] SOAP ABSORBING, SOAP DISPENSING CERAMIC STONE FOR SKIN EX-FOLIANT TREATMENT

[76] Inventor: Charles W. Aktinson, 109 N. Elmwood, Traverse City, Mich. 49684

[21] Appl. No.: 192,121

[22] Filed: Feb. 3, 1994

[51] Int. Cl.[6] ..... B24D 11/00

[52] U.S. Cl. ..... 51/295; 51/296; 51/308

[58] Field of Search ..... 51/295, 296, 298, 51/307, 308, 309; 401/196, 200

[56] References Cited

U.S. PATENT DOCUMENTS

| | | | |
|---|---|---|---|
| 2,880,081 | 3/1959 | Eubank | 51/308 |
| 4,581,287 | 4/1986 | Smith et al. | 51/296 |
| 4,662,897 | 5/1987 | Atkinson | 51/293 |
| 4,736,548 | 4/1988 | Atkinson | 51/293 |
| 5,152,809 | 10/1992 | Mattesky | 51/309 |

*Primary Examiner*—Deborah Jones
*Attorney, Agent, or Firm*—James M. Deimen

[57] ABSTRACT

A liquid soap absorbent, liquid soap dispensing synthetic ceramic stone of specified porosity with interconnecting voids throughout the body of the stone. The surface of the stone is mildly abrasive in a soap and water milieu. The interconnecting voids are substantially uniform enabling a liquid soap to thoroughly penetrate the stone by capillary action. In use, the liquid soap is continuously dispensed by dissolution in water and the aspirating action caused by a concave bottom surface of the stone and the seal provided by soap, water and skin at the point of use. As the liquid soap is drawn from the stone the interconnecting voids are cleared of the soap. With the depletion of the liquid soap from the stone a fresh charge of liquid soap is accomplished by merely placing the depleted stone in a shallow receptacle filled with liquid soap.

10 Claims, 1 Drawing Sheet

SOAP ABSORBING, SOAP DISPENSING CERAMIC STONE FOR SKIN EX-FOLIANT TREATMENT

BACKGROUND OF THE INVENTION

The field of the invention pertains to skin cleansing methods and materials, and in particular, to methods and materials that mildly abrade the skin surface in the process of applying soap and water.

Heretofore, in the field of skin therapy (callous removal, dry skin therapy) adequate abrading action normally results in pain and general inflammation of the skin area treated. The extreme sharpness and hardness of some of the available products for dry skin therapy and callous removal are the cause of the quick skin damage with a few strokes on the skin. Some of these products have hard abrasive particles supported in a relatively rigid matrix.

The known products fall typically into four (4) major categories:

1. Naturally occurring pumice stone and synthetic versions;
2. Coated abrasive products;
3. Metal stamped grating sheets;
4. Expanded urethane foam products.

All of these products are extremely abrasive with the exception of the natural pumice which is of dubious value. These products have met with limited commercial success and the market is clearly available for an effective and safe product.

SUMMARY OF THE INVENTION

The soap absorbent, soap dispensing ceramic stone comprises a synthetic ceramic of specified porosity with interconnecting voids throughout the body of the stone. The surface of the stone is mildly abrasive in a soap and water milieu. By careful design the interconnecting voids are substantially uniform enabling a liquid soap to penetrate the stone by capillary action.

In the preferred embodiment, a liquid soap of viscosity about 2500 centipoise may be absorbed through capillary action to occupy the entirety of the interconnecting voids. In use, the liquid soap is continuously dispensed by dissolution in water and the aspirating or vacuum action caused by the concave bottom surface of the ceramic stone and the seal provided by soap, water and skin at the point of use. The reversal of the capillary action is a natural reaction to the difference in pressure at the point of use and that of atmospheric pressure on the top of the ceramic stone.

As a result a mild skin therapy results from the soap and water lubricated abrading action and the clearing away of dead skin cells in the slurry of liquid soap and water. Moreover, the liquid soap is drawn from the ceramic stone and thereby cleared from the interconnecting voids. With the depletion of the liquid soap a fresh charge of liquid soap may be absorbed into the ceramic stone. Thus, the ceramic stone is repeatedly cleansed and recharged in normal use rather than discarded after depletion of the charge of liquid soap therein. The recharging of the ceramic stone is accomplished merely by placing the depleted stone in a shallow receptacle filled with the liquid soap.

DESCRIPTION OF THE PREFERRED EMBODIMENT

Figure 1:
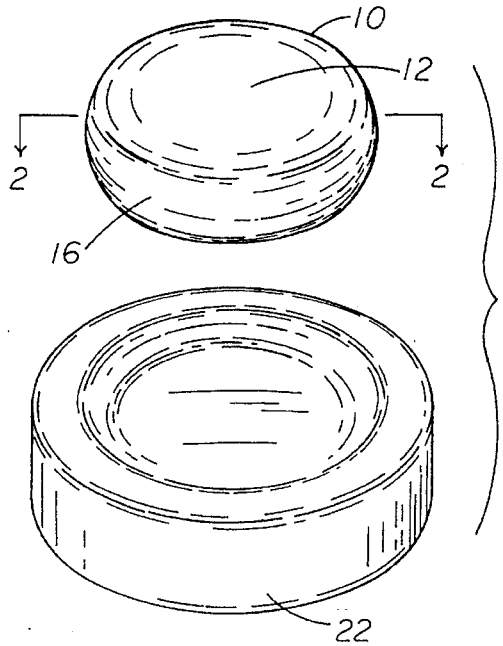
FIG. 1 is an orthographic projection of the ceramic stone and a holding saucer.
Figure 2:
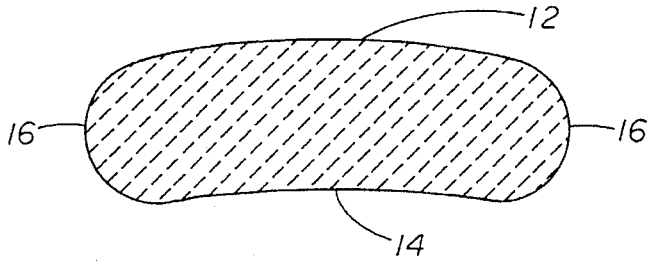
FIG. 2 is a diametral plane cross-section through the ceramic stone.

In FIG. 1 the exterior appearance of the ceramic stone is a circular body 10 of approximately three inches diameter and one inch in thickness. The upward facing crown 12 of the body 10 is generally convex in a gently rolled arc adequate to rest in the palm of a hand. As best shown in FIG. 2, the underside 14 of the body is gently concave in an arc approximately the curvature of the crown 12. The whole of the rim 16 is rolled with a radius that blends into the arcuate crown 12 and concave underside 14. The result is an elegant shape somewhat resembling a round bar of hand soap.

Figure 3:
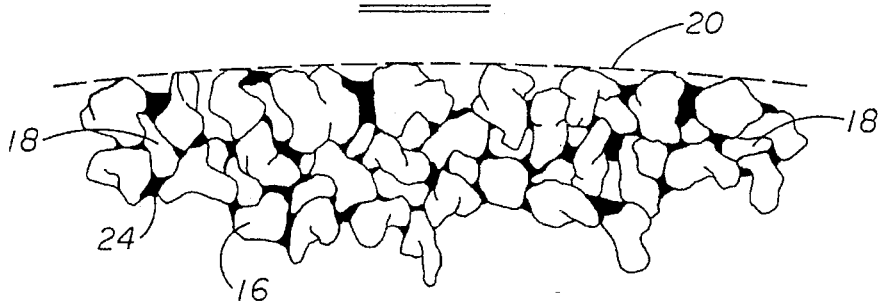
FIG. 3 is an illustration of the interior ceramic matrix structure of the stone.

Illustrated in FIG. 3 is the internal structure (exaggerated in scale) of the ceramic matrix 16 fused together as indicated by black spots 24 with the interconnecting voids 18 for the capillary absorption of liquid soap and retention of the soap until in the presence of water. As noted above, in the presence of water, the liquid soap is withdrawn from the voids as the concave underside 14 of the ceramic stone 10 is rubbed on the skin in a gentle cleansing and abrading action. Porous surface 20 is interrupted by the multiplicity of interconnecting voids, thus the mildly abrasive surface is formed by the voids 18 intersecting the surface.

The ceramic stone 10 is manufactured from the following ceramic materials and admixtures with the following steps:

Materials:

1. Abrasive particulates of silica derivation such as Novaculite, flint and common silica sand of 140/320 mesh spread;
2. Powdered glass frit comprised of borax, silica and trace metal oxides resulting in a soft glass fusion point of 1600 degrees F.–1700 degreés F.;
3. A cone 5 ball clay of kaolin derivative;
4. A temporary binder such as synthetic resin, sodium silica glass, dextrin or other material suitable for vaporization during organic burn-off in vitrification.

Material Proportions:

1. 65% by weight abrasive particulates;
2. 35% by weight bond
   a. 60% glass frit
   b. 40% cone 5 ball clay
3. A 5% by weight temporary binder in liquid form is added to 95% by weight of the above materials.

Mixing Procedure:

1. Combine the abrasive particulate in the mixing bowl and start the mixing action;
2. Add the temporary binder in liquid form and mix until thoroughly combined (5 minutes);
3. Slowly add the powdered bond and continue mixing action until thoroughly combined (3 minutes);
4. Discharge mixer and run the mixture through a gyratory riddle (or other screening mechanism) using a 18/24 mesh screen;
5. Cast mixture onto large drying surface and dry mix back from the wetness of the mixing procedure to approximately 1–2% moisture preparatory to cold pressing to shape;
6. Screen mix again to insure uniformity and collect mixture in suitable airtight container.

Pressing and Vitrification:

1. The mixture is pressed in a conventional carbide mold at a pressure not to exceed 5 tons per square inch to impose the shape illustrated in FIG. 1;
2. The cold pressed green stones are dried sufficiently to permit loading and firing and are arranged on suitable firing tiles;
3. The green stones are fired in a periodic or tunnel kiln at cone 1 (2040 degrees F.).

The green density of the soapstone before vitrification is 2.08 to 2.22 grams per cubic centimeter and is more than adequate to form a strong cold pressed body.

The cycle of firing is typical of porous ceramic products. The temperature is elevated slowly through the stages of organic binder burnout and up to 2040 degrees F. where a short soak of one to four hours may be required to bring an entire batch of stones to fusing temperature. A slow reduction of temperature is required to bring the stones down through glass annealing stages to room temperature without thermal shock. The slow elevation and reduction of temperature relieves the internal stresses of cold pressing and the stresses induced by cohesion at the fusion temperature of glass. The result is a ceramic stone having the following physical attributes:

1. A porous ceramic bonded mildly abrasive body of approximately 1.98 to 2.12 grams per cubic centimeter density with a void volume of 28% to 35%; and
2. A porous ceramic bonded mildly abrasive body which can absorb 20 percent of its weight in water because of the connecting internal voids formed in the vitrified stone.

For a ceramic stone approximately three inches in diameter and one inch thick, about 1 ounce of liquid soap having about 2500 centipoise viscosity can be absorbed by placing the ceramic stone 10 in the saucer as shown in FIG. 1 and adding the liquid soap to the saucer.

The vitrification permits the bonding of a soft abrasive particulate such as Novaculite having a hardness of about 7.5 on the MOH scale with a soft glass matrix 24 of about 6.5 on the MOH scale, thus providing a ceramic surface 20 with a gentle abrading action and an apparent surface hardness of about 7 on the MOH scale. Thus, the new ceramic stone may be distinguished from previous significantly harder abrasive particulates supported in a much more rigid matrix as presently used in the field of skin therapy.

Aside from having a suitable viscosity of about 2500 centipoise, the liquid soap may be quite arbitrary such as scented, unscented, herbal, medicinal or with a combination of features. Bubble baths of high surface tension and low liquid viscosity ensure a complete saturation of the ceramic stone and best suit the stone to its unique application.

Returning to FIG. 1 in the preferred embodiment, a shallow dish or saucer 22 is provided to hold the liquid soap and ceramic stone. The ceramic stone is placed in the shallow dish 22 with the concave underside 14 down. The ceramic stone remains partially immersed in the liquid soap for a sufficient period of time to fully absorb the liquid soap. When the liquid soap in the ceramic stone is depleted in bathing and hand washing, the stone is merely returned to the shallow dish with liquid soap therein for replenishment. By being self-cleaning in use and naturally self-filling in the shallow dish, the ceramic stone has an indefinite life for gentle, safe and effective abrading and cleansing of the skin.

I claim:

1. A porous ceramic abrasive body comprising a mildly abrasive particulate, a vitrified glass frit and clay bond and a plurality of interconnecting voids substantially uniform in size and distribution throughout the body, a convex top surface on the body, a concave bottom surface on the body and a circumferential sidewall surface on the body, the surfaces gently blending together to form a generally rounded body, and the surfaces being interrupted by a multiplicity of the interconnecting voids to form a mildly abrasive surface.

2. The ceramic abrasive body of claim 1 comprising 65% by weight abrasive particulate of 140/320 mesh spread, and 35% by weight vitrified glass frit and clay and having a density of approximately 1.98 to 2.12 grams per cubic centimeter inclusive of voids.

3. The ceramic abrasive body of claim 1 comprising about 28% to 35% voids by volume sized for capillary action by a liquid soap of about 2500 centipoise viscosity.

4. The ceramic abrasive body of claim 1 wherein the plurality of interconnecting voids are substantially filled with a liquid soap.

5. The ceramic abrasive body of claim 1 wherein the plurality of interconnecting voids are substantially sized to permit a liquid soap to be drawn in by capillary action and to be drawn out by the application of water to the body in combination with the gentle rubbing of the body on skin.

6. The ceramic abrasive body of claim 1 wherein the circumferential sidewall surface on the body forms a surface of revolution about an axis through the center of the convex top surface on the body and the concave bottom surface on the body.

7. The ceramic abrasive body of claim 6 wherein the body comprises about 65% by weight abrasive particulate of 140/320 mesh spread, about 35% by weight vitrified glass frit and clay and having a density of approximately 1.98 to 2.12 grams per cubic centimeter with about 28% to 35% voids by volume sized for capillary action of a liquid soap.

8. The ceramic abrasive body of claim 7 wherein the liquid soap has a viscosity of about 2500 centipoise.

9. The ceramic abrasive body of claim 1 having the interconnecting voids substantially filled with liquid soap, said soap dispensable by contacting the body with skin in an abrading manner in a water milieau.

10. The ceramic abrasive body of claim 10 comprising about 65% by weight abrasive particulate of 140/320 mesh spread and about 35% by weight vitrified glass frit and clay, the ceramic abrasive body having a density of approximately 1.98 to 2.12 grams per cubic centimeter and the liquid soap of about 2500 centipoise viscosity.

* * * * *

UNITED STATES PATENT AND TRADEMARK OFFICE

CERTIFICATE OF CORRECTION

PATENT NO. : 5,472,459
DATED : December 5, 1995
INVENTOR(S) : Charles W. Atkinson It is certified that error appears in the above-indentified patent and that said Letters Patent is hereby corrected as shown below:

Title page, item [76], inventor: should read--Atkinson--.

Signed and Sealed this

Nineteenth Day of November, 1996

*Attest:*

Bruce Lehman

BRUCE LEHMAN

*Attesting Officer*

*Commissioner of Patents and Trademarks*